US007975706B2

(12) United States Patent
Chen

(10) Patent No.: US 7,975,706 B2
(45) Date of Patent: Jul. 12, 2011

(54) MAKE-UP COMPACT

(76) Inventor: Sin-Hsiung Chen, Yung Kang (TW)

( * ) Notice: Subject to any disclaimer, the term of this patent is extended or adjusted under 35 U.S.C. 154(b) by 331 days.

(21) Appl. No.: 12/400,546

(22) Filed: Mar. 9, 2009

(65) Prior Publication Data

US 2010/0224212 A1 Sep. 9, 2010

(51) Int. Cl.

| | |
|---|---|
| ***A45D 33/20*** | (2006.01) |
| ***A45D 40/24*** | (2006.01) |
| ***A45D 42/08*** | (2006.01) |
| ***B65D 69/00*** | (2006.01) |
| ***B65D 43/12*** | (2006.01) |
| ***B65D 43/20*** | (2006.01) |

(52) U.S. Cl. ..... 132/287; 132/314; 132/291; 206/581; 220/345.4

(58) Field of Classification Search ..... 132/287, 132/286, 291, 294, 295, 297, 314, 315, 316, 132/301–305; D28/78, 83, 84, 91; 206/581, 206/235, 6.1, 823, 751, 752, 754, 387.12, 206/804; 220/811, 812, 813, 814, 815, 820, 220/345.1, 345.4, 351, 345.2, 348, 377, 23.83, 220/23.86, 23.88, 507; 312/330.1, 334.27, 312/350

See application file for complete search history.

(56) References Cited

U.S. PATENT DOCUMENTS

| | | | | | |
|---|---|---|---|---|---|
| 1,321,026 | A | * | 11/1919 | Freed | 362/196 |
| 1,512,352 | A | * | 10/1924 | Mallardi | 132/314 |
| 1,936,273 | A | * | 11/1933 | Segal | 70/456 R |
| 4,300,675 | A | * | 11/1981 | Wagner | 206/252 |
| 4,388,935 | A | * | 6/1983 | Napolitane | 132/294 |
| 4,526,273 | A | | 7/1985 | Tsuji et al. | |
| 4,932,547 | A | * | 6/1990 | Rodriguez | 220/8 |
| 4,947,989 | A | * | 8/1990 | Horton | 206/387.1 |
| 5,163,457 | A | * | 11/1992 | Lombardi, Jr. | 132/304 |
| 5,353,947 | A | * | 10/1994 | Zinnbauer et al. | 220/812 |
| 5,598,925 | A | * | 2/1997 | Bieck | 206/387.1 |
| 6,021,784 | A | * | 2/2000 | Yuhara | 132/293 |
| 6,129,237 | A | * | 10/2000 | Miyahara | 220/812 |

(Continued)

FOREIGN PATENT DOCUMENTS

DE 20 2008 007 236 9/2008

(Continued)

OTHER PUBLICATIONS

European Search Report mailed May 6, 2010.

(Continued)

*Primary Examiner* — Todd E Manahan
*Assistant Examiner* — Vanitha Elgart
(74) *Attorney, Agent, or Firm* — Hershkovitz & Associates, LLC; Abe Hershkovitz

(57) ABSTRACT

A make-up compact has a hollow base, a lateral tray, a front cover and a slider. The base has a front surface and an oblique slot. The oblique slot is formed on the front surface and communicates with a chamber of the base. The lateral tray for containing cosmetics is slidably mounted in the base and has an edge and a longitudinal slot formed in the edge. The front cover is movably mounted on the base and has a rear surface and a transverse slot formed on the rear surface. The slider is slidably mounted in the longitudinal slot and protrudes through the oblique slot into the transverse slot. As the front cover moves, the front cover induces the slider to move the lateral tray for improved convenience.

14 Claims, 6 Drawing Sheets

U.S. PATENT DOCUMENTS

| | | | | |
|---|---|---|---|---|
| 6,363,947 | B1 * | 4/2002 | Wu | 132/297 |
| 6,386,210 | B1 * | 5/2002 | Slater | 132/294 |
| 7,431,161 | B2 * | 10/2008 | Carlino | 206/581 |
| 2002/0039890 | A1 * | 4/2002 | Kim | 455/90 |
| 2004/0108318 | A1 * | 6/2004 | Wang | 220/345.2 |
| 2005/0092763 | A1 * | 5/2005 | Haggerty et al. | 220/912 |
| 2006/0079301 | A1 * | 4/2006 | Kim et al. | 455/575.3 |
| 2007/0164032 | A1 * | 7/2007 | Cronin et al. | 220/345.1 |
| 2008/0035643 | A1 * | 2/2008 | Hoffman et al. | 220/345.4 |
| 2008/0289645 | A1 | 11/2008 | Guillot | |
| 2009/0288677 | A1 * | 11/2009 | Chen | 132/315 |
| 2011/0032668 | A1 * | 2/2011 | Lee | 361/679.01 |

FOREIGN PATENT DOCUMENTS

| | | |
|---|---|---|
| EP | 1 994 852 | 11/2008 |
| FR | 2 889 427 | 2/2007 |

OTHER PUBLICATIONS

English Abstract of EP 1 994 852.

English Abstract of FR 2 889 427.

* cited by examiner

MAKE-UP COMPACT

BACKGROUND OF THE INVENTION

1. Field of the Invention

The present invention relates to a make-up compact, and more particularly to a make-up compact that allows cosmetics to be conveniently and easily carried and used.

2. Description of Related Art

Applying make-up requires various cosmetics and applicators including: foundation, face powder, powder puff, lipstick, mascara, eye shadow, and the like. Each cosmetic is provided in a container, may require a specific applicator and may last for different time depending on products, contact or environmental factors, so the cosmetics and applicators are carried for reapplication, frequently in a bag. Further, due increased time demands, makeup may be carried to change style after work, at night, or while commuting. However, storing cosmetics in the bag may hinder selection and location of required cosmetic and cosmetics may collide causing leakage and damage to cosmetics, applicators and containers.

Further to the cosmetics, a mirror is also required, so the bag, mirror and required cosmetic must be held simultaneously, but such juggling, especially when moving during a commute, may cause misapplication, loss of cosmetics from the bag or the like.

To overcome the shortcomings, the present invention provides a make-up compact to mitigate or obviate the aforementioned problems.

SUMMARY OF THE INVENTION

The main objective of the invention is to provide a make-up compact for conveniently and easily using cosmetics.

A make-up compact has a hollow base, a lateral tray, a front cover and a slider. The base has a front surface and an oblique slot. The oblique slot is formed on the front surface and communicates with a chamber of the base. The lateral tray for containing cosmetics is slidably mounted in the base and has an edge and a longitudinal slot formed in the edge. The front cover is movably mounted on the base and has a rear surface and a transverse slot formed on the rear surface. The slider is slidably mounted in the longitudinal slot and protrudes through the oblique slot into the transverse slot. As the front cover moves, the front cover induces the slider to move the lateral tray for improved convenience.

Other objectives, advantages and novel features of the invention will become more apparent from the following detailed description when taken in conjunction with the accompanying drawings.

DETAILED DESCRIPTION OF PREFERRED EMBODIMENT

Figure 1:
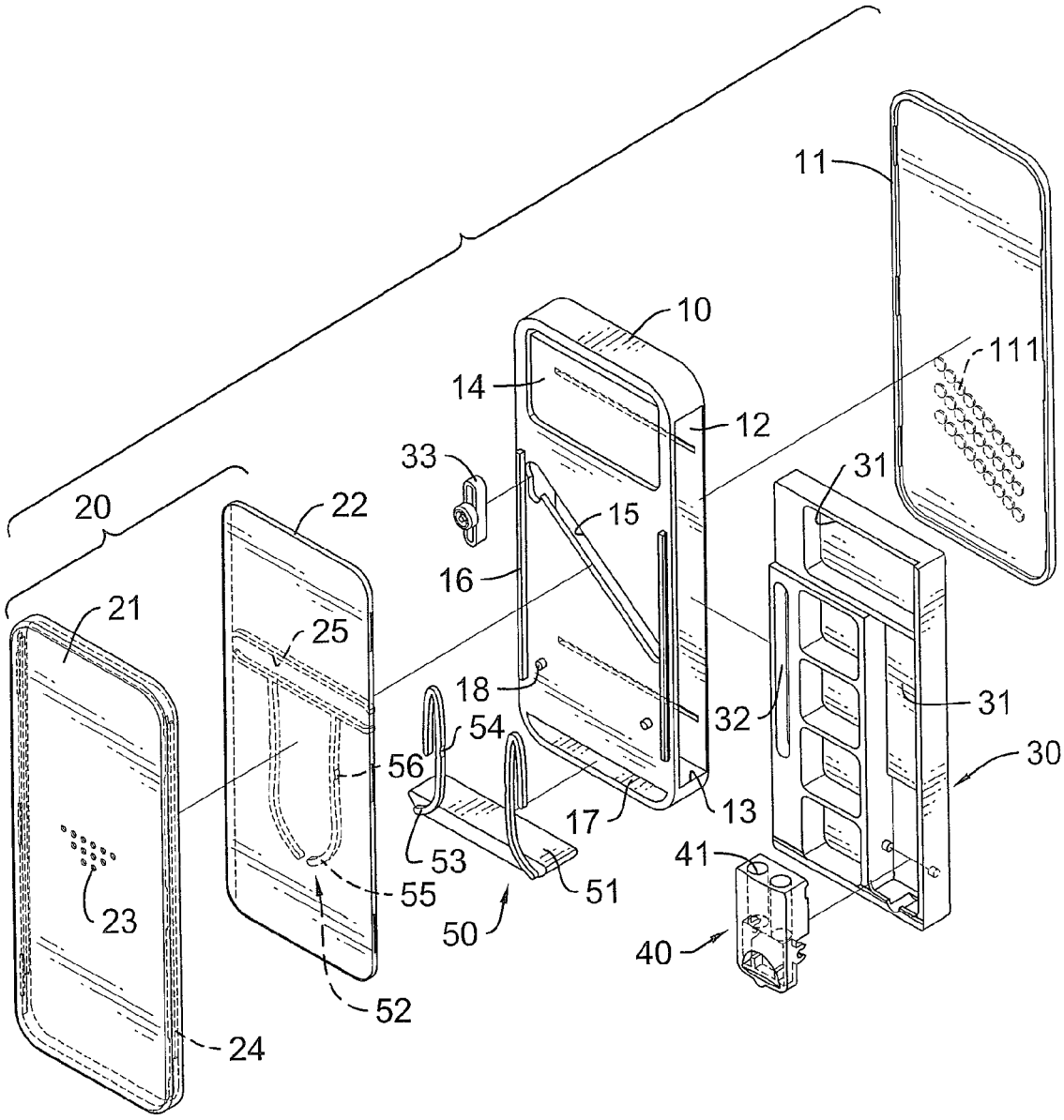
FIG. 1 is an exploded perspective view of a make-up compact in accordance with the present invention.
Figure 2:
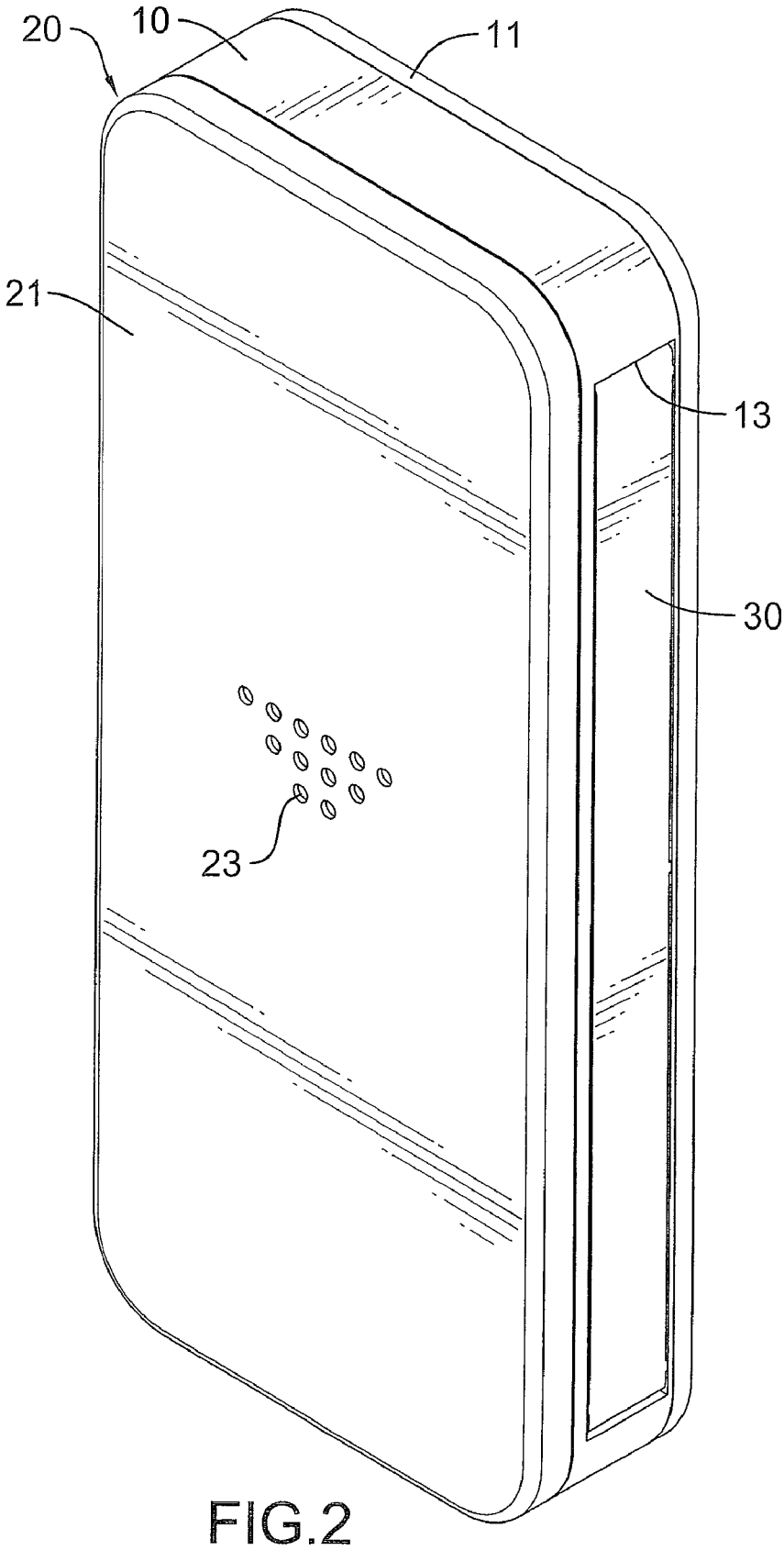
FIG. 2 is a perspective view of the make-up compact in FIG. 1.
Figure 3:
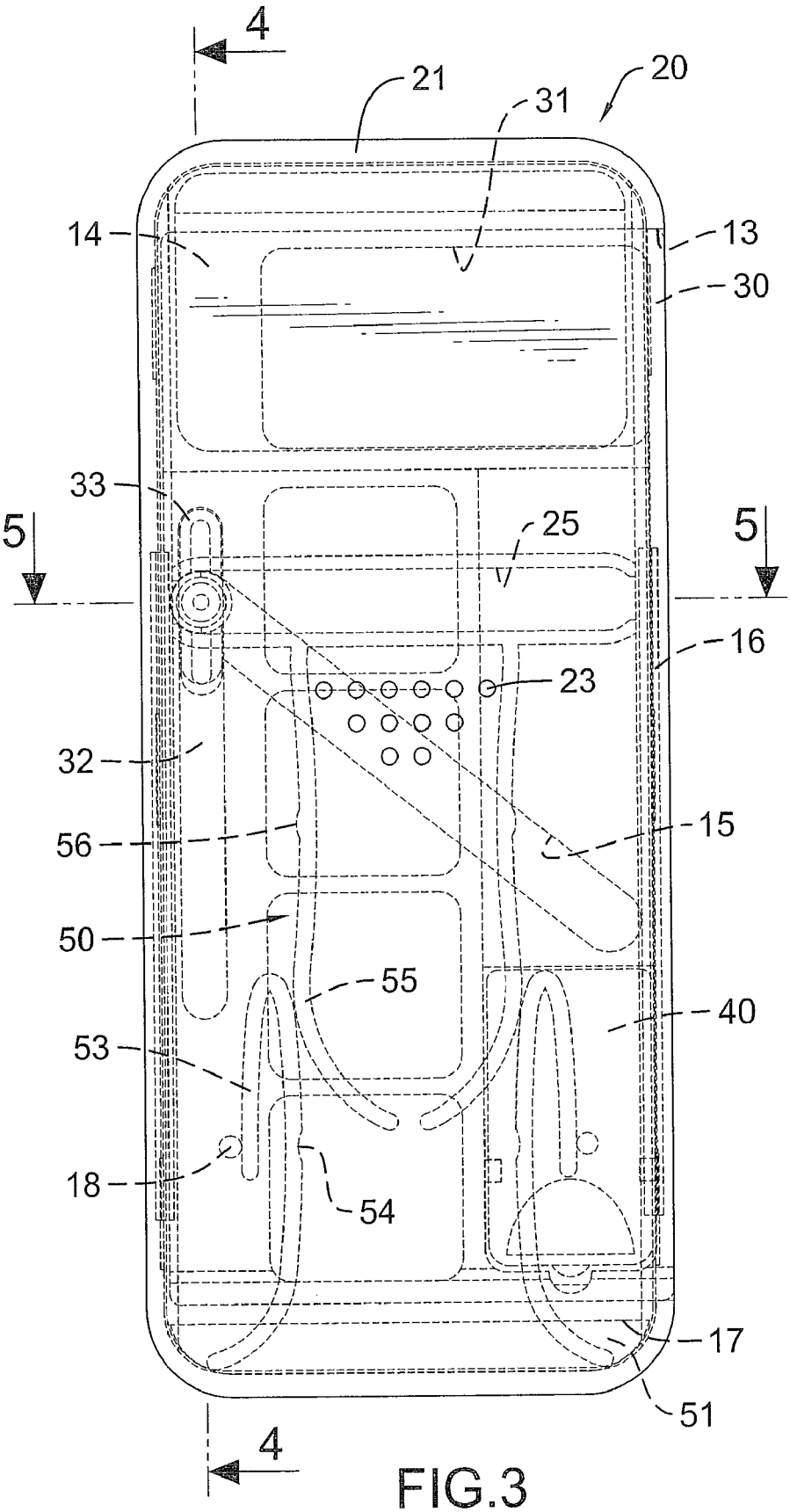
FIG. 3 is a front view of the make-up compact in FIG. 1, with internal elements shown in phantom lines.

With reference to FIGS. 1 to 3, a make-up compact has a base (10), a front cover (20), a lateral tray (30) and a slider (33) and may further have a buffer assembly (50).

The base (10) has a side, a mount surface, a chamber (12), an opening (13), a front surface, a mirror (14) and an oblique slot (15) and may have a rear cover (11), two guide rails (16), multiple stops (18), a buffer mount (17), a decoration and two transverse guides.

The chamber (12) is defined in the base (10).

The opening (13) is formed through the side and communicates with the chamber (12).

The front surface has an upper segment and a lower segment.

The mirror (14) is mounted on the upper segment of the front surface.

The oblique slot (15) is formed through the lower segment of the front surface and communicates with the chamber (12).

The rear cover (11) is mounted on the mount surface of the base (10), may be transparent and has an outer surface and a handgrip (111). The handgrip (111) is formed on the outer surface and may comprise multiple grooves, recesses, resilient ribs, bosses or the like.

The guide rails (16) are formed on the front surface of the base (10), and each guide rail (16) may have a neck and a head. The head of the guide rail (16) may be wider than the neck and protrude from one or both sides. The stops (18) are formed on and protrude from the lower segment of the front surface. The buffer mount (17) is formed on the lower segment of the front surface and may be a trough, protrusion or the like. The decoration may comprise letters, words, shapes, pictures, pattern or the like and is disposed between the base (10) and the rear cover (11) and may be a trademark or brand. When the rear cover (11) is transparent, the decoration is revealed yet protected. The transverse guides are formed in the chamber (12).

The front cover (20) is slidably mounted on the front surface of the base (10) and has a rear surface and a transverse slot (25) and may have an exterior panel (21), an interior panel (22), two guide grooves (24) and a decoration.

The rear surface of the front cover (20) may be the interior panel (22) and be opposite to the exterior panel (21) and is disposed adjacent to the front surface of the base (10).

The transverse slot (25) is formed on the rear surface.

The exterior panel (21) may be transparent and has an annular edge, an outer surface, a mount surface, a sidewall, two guide grooves (24) and a finger grip (23). The sidewall may have an inner surface. The guide grooves (24) are formed on the front cover (20) and may be formed on the inner surface of the sidewall of the exterior panel (21) and respectively correspond to and engage the two guide rails (16) of the base (10) to allow the front cover (20) to transversely move along the guide rails (16). The mount surface is surrounded by the sidewall. The finger grip (23) is formed on the outer surface and may comprise resilient protrusions, bosses, ribs, grooves or the like.

The interior panel (22) is mounted on the mount surface of the exterior panel (21). The decoration of the front cover (20) may comprise letters, words, shapes, pictures, and is disposed between the exterior panel (21) and the interior panel (22). The decoration of the front cover (20) may be a trademark, brand or the like. Due to the transparent exterior panel (21), the decoration can be revealed without being damaged.

The lateral tray (30) is movably mounted in the chamber (12) of the base (10) for containing cosmetics and has an edge and a longitudinal slot (32) and may have at least one compartment (31), a holder (40), an inner surface and two slide protrusions.

The edge is mounted in the base (10). The longitudinal slot (32) is formed in the edge of the lateral tray (30).

The at least one compartment (31) is formed in the lateral tray and may be filled with a cosmetic or securely receive a cosmetic pouch.

The holder (40) is pivotally mounted in the at least one compartment (31) and has an end and at least one hole (41). The at least one hole (41) is formed in the end of the holder (40) to allow pencil-shaped cosmetics and applicators, such as but not limited to pencils, mascaras, wands, liners, lipsticks, gloss, or the like to be placed and stored securely.

The inner surface is opposite to the surface of the lateral tray (30).

The two slide protrusions are formed on the inner surface and respectively protrude into the two transverse guides to limit and to guide the lateral tray (30) to move transversely.

Figure 4:
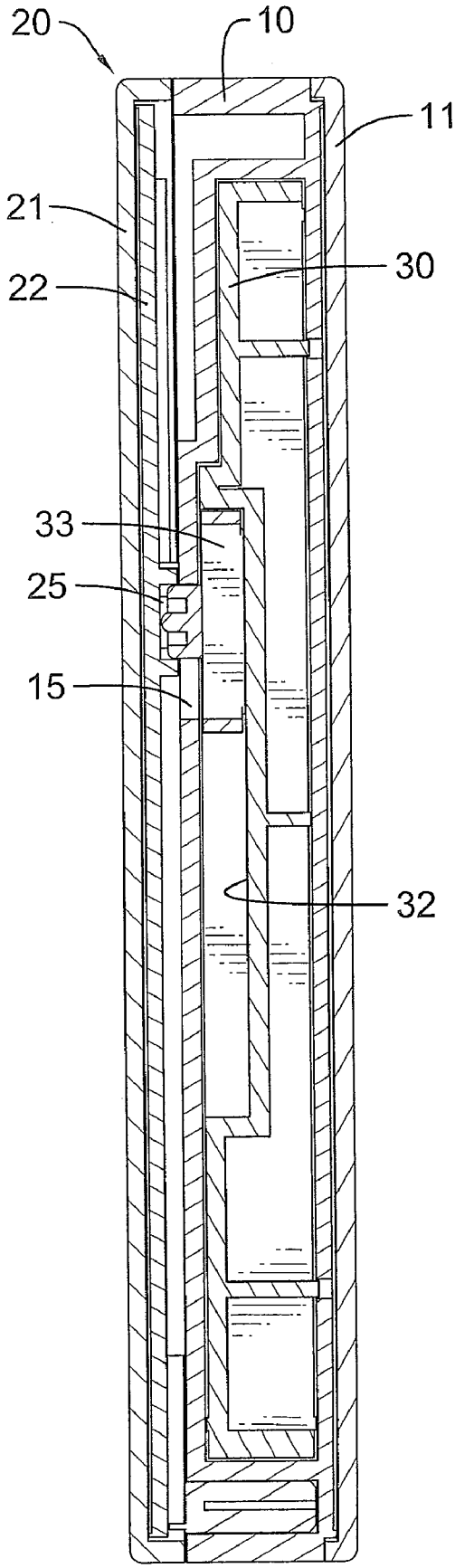
FIG. 4 is side view in partial section taken along line 4-4 of the make-up compact in FIG. 3.
Figure 5:
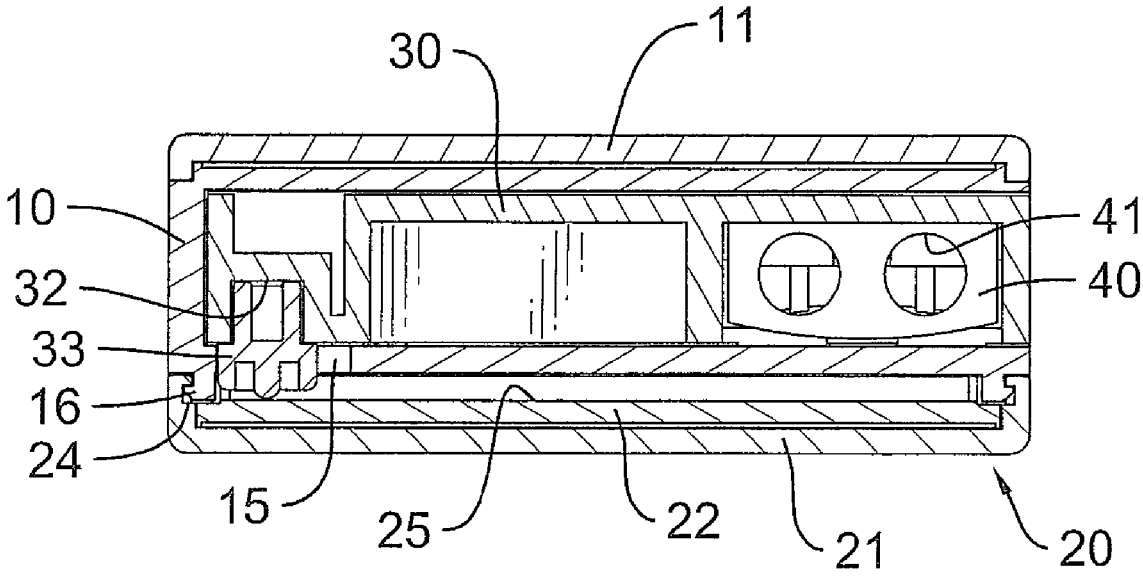
FIG. 5 is top view in partial section taken along line 5-5 of the make-up compact in FIG. 3.

With further reference to the FIG. 4 and FIG. 5, the slider (33) is slidably mounted in the longitudinal slot (32) of the lateral tray (30) and protrudes through the oblique slot (15) of the base (10) and into the transverse slot (25) of the front cover (20). The slider (33) may have a longitudinal slider and an oblique slider. The longitudinal slider is slidably mounted in the longitudinal slot (32) of the lateral tray (30). The oblique slider is connected to the longitudinal slider and protrudes through the oblique slot (15) of the base (10) and into the transverse slot (25) of the interior panel (22).

Figure 6:
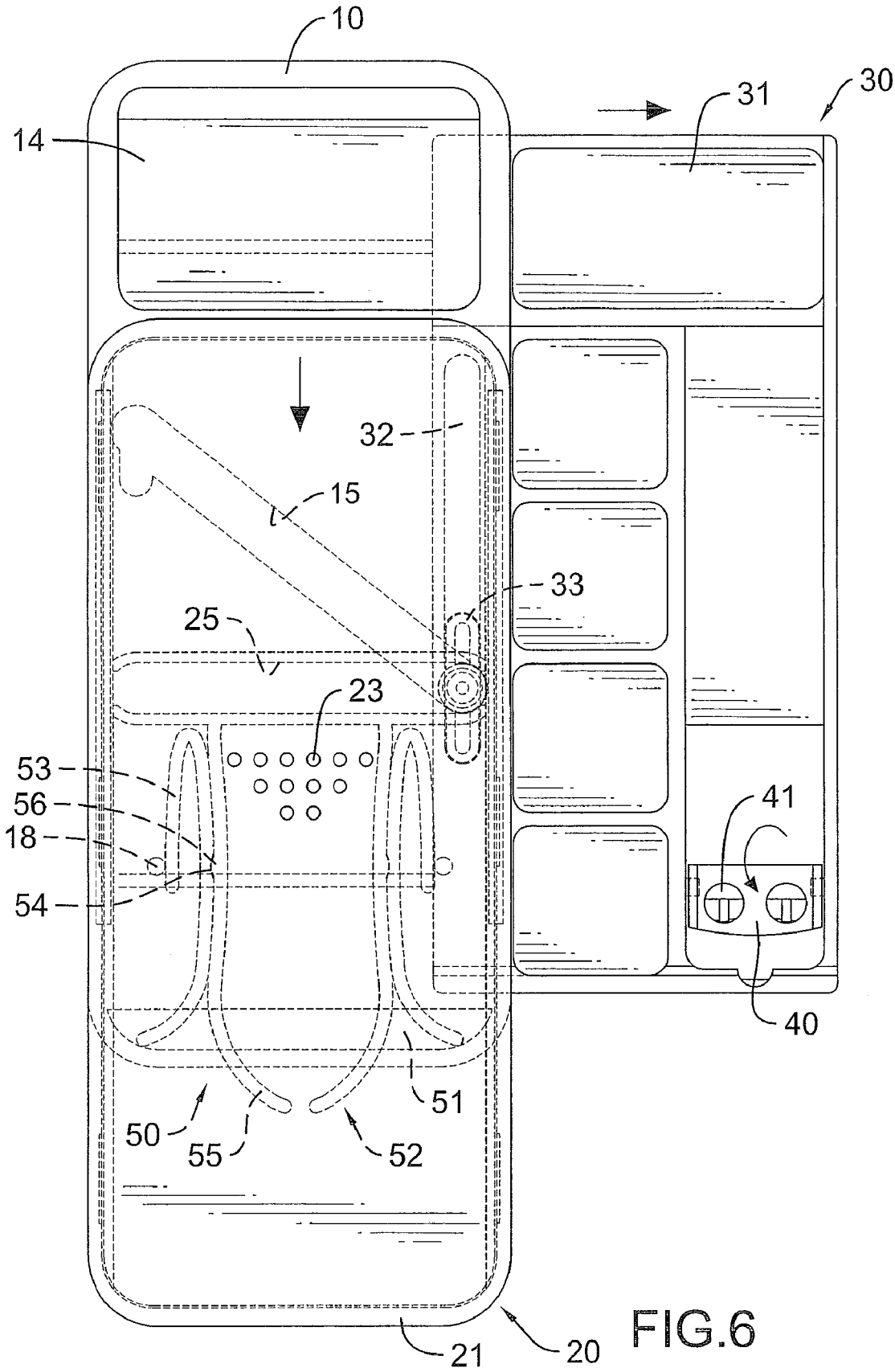
FIG. 6 is a front view of the make-up compact in FIG. 3 showing a lateral tray moving out.

With further reference to FIG. 6, the buffer assembly (50) has a stationary buffer (51) and a moving buffer (52). The stationary buffer (51) is mounted in the buffer mount (17) of the base (10) and has two resilient arms (53). The resilient arms (53) abut corresponding stops (18) of the base (10) and each resilient arm (53) has a recessed detent (54). The recessed detents (54) of the resilient arms (53) face inward. The moving buffer (52) is mounted on the rear surface of the front cover (20) and has two mounting arms (55). The mounting arms (55) protrude through and between the resilient arms (53) and each mounting arm (55) has a protruding detent (56). The protruding detents (56) are formed on the mounting arms (55) and correspond to the recessed detents (54) of the resilient arms (53).

Moving the front cover (20) pushes the slider (33) to move and the slider (33) pushes the lateral tray (30) partially out from the chamber (12) of the base (10) to reveal the at least one compartment (31) of the lateral tray (30). Due to the at least one compartment (31) being revealed, the cosmetics can be used conveniently. As the front cover (20) moves, the mounting arms (55) of the moving buffer (52) move deeper between the resilient arms (53) of the stationary buffer (51) and the protruding detents (56) of the moving buffer (52) move in the recessed detent (54) of the stationary buffer (51) and are held. The front cover (20) or the lateral tray (30) can be returned to simultaneously force the other to return.

Because the at least one compartment (31) of the lateral tray (30) can contain cosmetics and related products, carrying and applying different kinds of cosmetics is facilitated. People can hold the make-up compact with one hand and reveal the mirror (14) and the compartment (31) of the lateral tray (30) by sliding down the finger grip (23) of the front cover (20) with a thumb or a finger so people can watch the mirror (14) to wear make-up or reapply. People can also use pencil-shaped cosmetics and applicators stuck in the at least one hole (41) of the holder (40). Therefore, people can use cosmetics easily and conveniently in the make-up compact.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A make-up compact comprising:
- a base having
  - a side;
  - a chamber being defined in the base;
  - an opening being formed through the side and communicating with the chamber;
  - a front surface having an upper segment and a lower segment;
  - a mirror being mounted on the upper segment of the front surface; and
  - an oblique slot being formed on the lower segment of the front surface and communicating with the chamber;
- a front cover being slidably mounted on the front surface of the base and having
  - a rear surface being disposed adjacent to the front surface of the base; and
  - a transverse slot being formed on the rear surface;
- a lateral tray being movably mounted in the chamber of the base for containing cosmetics and having
  - an edge being mounted in the base; and
  - a longitudinal slot being formed in the edge; and
- a slider being slidably mounted in the longitudinal slot of the lateral tray and protruding through the oblique slot of the base and into the transverse slot of the front cover.

2. The make-up compact as claimed in claim 1, wherein
- the base further has two guide rail being formed on the front surface of the base and protruding vertically; and
- the front cover further has two guide grooves formed on the front cover and engaging the guide rails of the base.

3. The make-up compact as claimed in claim 2, wherein the front cover further has
- an exterior panel having
  - an outer surface;
  - a mount surface opposite to the outer surface; and
  - a finger grip being formed on the outer surface; and
- an interior panel being mounted on the mount surface, wherein the rear surface of the front cover is the interior panel.

4. The make-up compact as claimed in claim 3, wherein the base has
- a mount surface; and
- a rear cover being mounted on the mount surface of the base and having an outer surface and a handgrip being formed on the outer surface.

5. The make-up compact as claimed in claim 4, wherein
- the base further has
  - a buffer mount being formed on the lower segment of the front surface of the base; and
  - multiple stops being formed on and protruding from the lower segment of the front surface of the base; and
- the make-up compact further has a buffer assembly having
  - a stationary buffer being mounted in the buffer mount of the base and having two resilient arms protruding through and between the two stops of the base and having recessed detents formed facing inward; and
  - a moving buffer being mounted on the rear surface of the interior panel and having two mounting arms protruding through and between the resilient arms and having protruding detents corresponding to the recessed detents of the resilient arms.

6. The make-up compact as claimed in claim 5, wherein the lateral tray has at least one compartment being formed in the lateral tray; and a holder being pivotally mounted in the at least one compartment.

7. The make-up compact as claimed in claim 6, wherein the exterior panel is transparent.

8. The make-up compact as claimed in claim 7, wherein the rear cover is transparent.

9. The make-up compact as claimed in claim 1, wherein the front cover has an exterior panel having an outer surface;

a mount surface opposite to the outer surface; and a finger grip being formed on the outer surface; and an interior panel being mounted on the mount surface, wherein the rear surface of the front cover is the interior panel.

10. The make-up compact as claimed in claim 9, wherein the base has a mount surface; and a rear cover being mounted on the mount surface of the base and having an outer surface and a handgrip being formed on the outer surface.

11. The make-up compact as claimed in claim 10, wherein the base further has a buffer mount being formed on the lower segment of the front surface of the base; and multiple stops being formed on and protruding from the lower segment of the front surface of the base; and the make-up compact further has a buffer assembly having a stationary buffer being mounted in the buffer mount of the base and having two resilient arms protruding through and between the two stops of the base and each resilient arm having recessed detents formed facing inward; and a moving buffer being mounted on the rear surface of the interior panel and having two mounting arms protruding through and between the two resilient arms and having protruding detents corresponding to the recessed detents of the resilient arms.

12. The make-up compact as claimed in claim 11, wherein the lateral tray has at least one compartment being formed in the lateral tray; and a holder being pivotally mounted in the at least one compartment.

13. The make-up compact as claimed in claim 12, wherein the exterior panel is transparent.

14. The make-up compact as claimed in claim 13, wherein the rear cover is transparent.

* * * * *